US008824713B2

(12) United States Patent
Engbert et al.

(10) Patent No.: US 8,824,713 B2
(45) Date of Patent: Sep. 2, 2014

(54) MICROPHONE FOR A HEARING AID

(71) Applicant: Sonion Nederland B.V., Amsterdam (NL)

(72) Inventors: Wilmink Engbert, Delft (NL); Aart Zeger van Halteren, Hobrede (NL); Hendrik Dollerman, Assendelft (NL); Paul Christiaan van Hal, Hoorn (NL)

(73) Assignee: Sonion Nederland B.V., Hoofddorp (NL)

( * ) Notice: Subject to any disclaimer, the term of this patent is extended or adjusted under 35 U.S.C. 154(b) by 121 days.

(21) Appl. No.: 13/734,659

(22) Filed: Jan. 4, 2013

(65) Prior Publication Data

US 2013/0142370 A1 Jun. 6, 2013

Related U.S. Application Data

(62) Division of application No. 11/879,246, filed on Jul. 17, 2007, now Pat. No. 8,369,552, which is a division of application No. 09/958,867, filed as application No. PCT/NL00/00222 on Apr. 5, 2000, now Pat. No. 7,292,700.

(30) Foreign Application Priority Data

Apr. 13, 1999 (NL) ..... 1011778

(51) Int. Cl.
*H04R 25/00* (2006.01)

(52) U.S. Cl.
USPC ..... 381/323; 381/324; 381/322; 381/328

(58) Field of Classification Search
USPC ..... 381/322–324, 328
See application file for complete search history.

(56) References Cited

U.S. PATENT DOCUMENTS

| | | | |
|---|---|---|---|
| 3,701,862 | A | 10/1972 | Vignini |
| 4,592,087 | A | 5/1986 | Killion |
| 4,689,819 | A | 8/1987 | Killion |

(Continued)

FOREIGN PATENT DOCUMENTS

| | | |
|---|---|---|
| DE | 3623906 | 1/1988 |
| DE | 19545760 | 2/1997 |

(Continued)

OTHER PUBLICATIONS

International Search Report corresponding to International Patent Application Serial No. PCT/NL00/00222, European Patent Office, dated Sep. 20, 2000, 3 pages.

*Primary Examiner* — Suhan Ni
(74) *Attorney, Agent, or Firm* — Nixon Peabody LLP

(57) ABSTRACT

A microphone assembly having a housing, a transducer, and an electronic circuit. The housing has an opening, and the transducer is disposed within that opening. The electronic circuit covers the opening such that the transducer is surrounded by at least the electronic circuit and the housing. The electronic circuit includes a substrate and an amplifier for amplifying the electrical signal into an amplified electrical signal which is coupled to a connection means. The connection means provides a direct electrical connection between the electronic circuit and a receiver. The amplifier is mounted on the substrate and disposed on a side of the substrate of the electronic circuit facing the transducer. The receiver is disposed on a side opposite the side and outside the housing.

11 Claims, 3 Drawing Sheets

(56) References Cited

U.S. PATENT DOCUMENTS

| | | | |
|---|---|---|---|
| 4,947,439 | A | 8/1990 | Buettner |
| 4,993,072 | A | 2/1991 | Murphy |
| 5,001,762 | A | 3/1991 | Barwig et al. |
| 5,097,515 | A | 3/1992 | Baba |
| 5,195,139 | A | 3/1993 | Gauthier |
| 5,255,246 | A | 10/1993 | van Halteren |
| 5,265,168 | A | 11/1993 | Schiess et al. |
| 5,589,799 | A | 12/1996 | Madaffari et al. |
| 5,623,550 | A | 4/1997 | Killion et al. |
| 5,661,420 | A | 8/1997 | Killion et al. |
| 5,995,636 | A | 11/1999 | Topholm |
| 6,169,810 | B1 | 1/2001 | van Halteren et al. |
| 6,546,110 | B1 | 4/2003 | Vonlanthen |
| 6,549,632 | B1 | 4/2003 | Akino et al. |
| 7,010,137 | B1 | 3/2006 | Leedom et al. |
| 7,853,032 | B2 | 12/2010 | Heerlein et al. |

FOREIGN PATENT DOCUMENTS

| | | |
|---|---|---|
| EP | 0082700 | 6/1983 |
| EP | 0169990 | 2/1986 |
| EP | 0332938 | 1/1989 |
| EP | 0491072 | 12/1990 |
| EP | 0847227 | 3/1998 |
| EP | 0988776 | 3/2000 |
| FR | 2547687 | 12/1984 |
| WO | 95/22879 | 8/1995 |
| WO | 96/10321 | 4/1996 |
| WO | 98/47319 | 10/1998 |
| WO | 00/21336 | 4/2000 |
| WO | 00/41432 | 7/2000 |

MICROPHONE FOR A HEARING AID

CROSS REFERENCE TO RELATED APPLICATION

This application is a divisional of U.S. patent application Ser. No. 11/879,246, filed on Jul. 17, 2007, which is a divisional application of application Ser. No. 09/958,867 filed Oct. 12, 2001, which is a U.S. national phase of International Application No. PCT/NL00/00222, filed Apr. 5, 2000, which is a complete and foreign application of Dutch patent application No. 1011778, filed Apr. 13, 1999, all of which are hereby incorporated by reference in their entireties.

BACKGROUND OF THE INVENTION

The invention relates to a microphone for a hearing aid, the microphone comprising a housing with entrance means for letting pass sound waves into the housing, transducer means for converting the sound waves into an electrical signal, amplifier means for amplifying this electrical signal and connecting means for connecting the amplifier means with the terminals of a battery and for coupling the output signal of the amplifier means to a receiver. Such a microphone for example is disclosed in EP-A-0802700.

This invention also relates to a hearing aid including a body accommodating a microphone of the above type, a battery and a receiver.

Although hearing aids nowadays are much smaller than some years ago, while also the reliability and the sound quality have been improved, there still are some disadvantages that have to be overcome. Such disadvantages are for example the number of wires necessary to connect the microphone, amplifier, receiver and battery. These wires can influence negatively the reliability of the hearing aid and make the production thereof expensive. The wires are also at least part of the cause of interference by cellular phones and other radio frequency sources. Thus expensive solutions to prevent such interference are required. Another disadvantage is the size of the state of the art hearing aids, which is still too large to fit all ears with a Completely In the Canal (CIC) hearing aid.

In the state of the art hearing aids the microphone generally is an electret microphone with integrated CMOS or J-FET buffer. The amplifier comprises one or more discrete components and integrated circuits mounted on a hybrid printed circuit board. The receiver generally is a balanced armature receiver.

EP-A-0802700 describes a microphone, the housing of which includes a differential preamplifier.

DE-A-19545761 describes a proposal to integrate an A/D converter in a microphone for a hearing aid, while U.S. Pat. Nos. 4,592,087 and 4,689,819 propose to integrate the power amplifier in the microphone of a hearing aid.

SUMMARY OF THE INVENTION

The invention aims to overcome at least part of the still existing disadvantages of the state of the art hearing aids and to this effect provides a microphone for a hearing aid of the above-mentioned type, characterized in that the housing of the microphone an electronic circuit is provided at an output of which a signal is available that can be transmitted directly to the receiver.

Preferably, all active components of the electronic circuit are formed in one single integrated circuit.

If necessary, some passive components, like resistors or capacitors, can be provided at the outside of the housing of the microphone.

In a further embodiment of a microphone according to the invention, at the outside of the housing fixed spring biased connections are provided for a solderless contact with the battery terminals.

According to again another embodiment of the invention, the body of the hearing aid comprises a battery holder with a removable cap, entrance means for sound waves being provided from outside the body to the interior of the battery holder and from the battery holder to the interior of the microphone housing. Preferably, the entrance means for the battery holder are formed in the removable cap.

BRIEF DESCRIPTION OF THE DRAWINGS

Embodiments of the invention and their advantages shall be discussed below with reference to the figures of the drawing, which show.

DETAILED DESCRIPTION OF THE INVENTION

Figure 1:
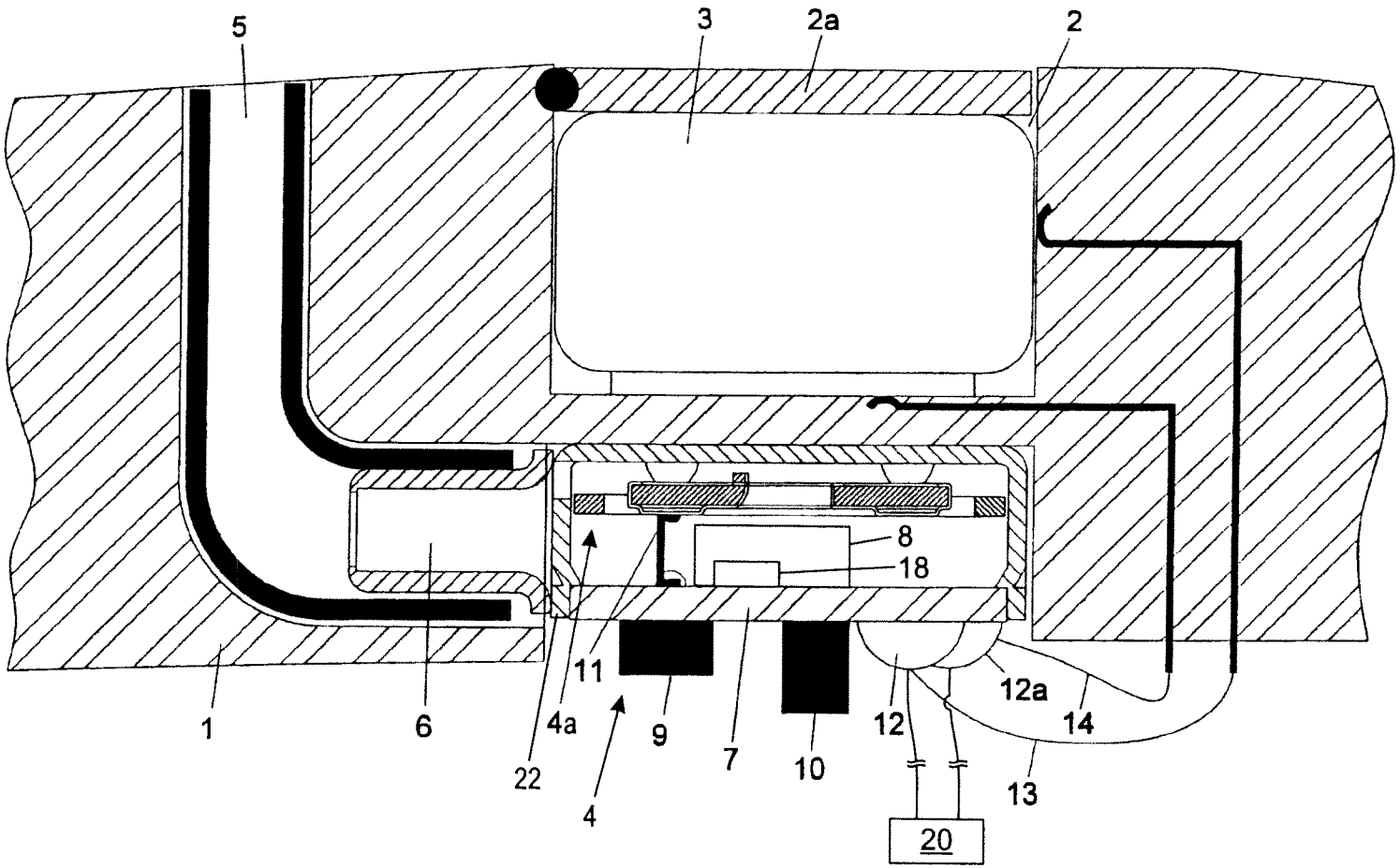
FIG. 1 a cross-sectional view of a first embodiment of the invention.

FIG. 1 shows a part of a body 1 of a hearing aid comprising a battery holder 2 with a removable cap 2*a* for a battery 3, a space for accommodating the housing 22 of a microphone assembly 4 and an inlet channel 5 through which sound waves from the exterior can pass to the inlet opening 6, that is provided in a wall of the housing 22 of the microphone assembly 4. Disposed within the housing 22 of the microphone assembly 4 is a transducer 4*a*.

The transducer 4*a* is a conventional microphone of the electret type, for example as described in U.S. Pat. No. 5,255,246; details of the transducer 4*a* are not given here, because they are not really relevant for the present invention. A hybrid 7 is provided on which an integrated circuit 8 and, if necessary, passive components 9, 10 are mounted by means of a flip-chip technology or by means of wire bonding. The connection between the transducer 4*a* and the substrate of the hybrid 7 is made by means of a flexible connection 11 of the type disclosed in U.S. Pat. No. 5,255,246. On the side of the substrate of the hybrid 7 that is at the outside of the housing 22, solder pads 12, 12*a* are provided for connecting the microphone 4 to the battery terminals, through leads 13 and 14 and for connecting the output signal of an amplifier 18, that is included in the integrated circuit 108, to a receiver 120. For the sake of clarity, only the solder pads 12, 12*a* are shown, the solder pads for connection to the receiver 120 are not shown, but their structure will be clear to those skilled in the art.

Instead of solder pads also other connection means can be provided as, for example, a flexible band with connecting wires printed on it (a so-called flexprint). Instead of a hybrid also the use of a printed circuit board or a flexprint is possible.

By the construction of a microphone 4 in accordance with FIG. 1, all sensitive electronic parts are shielded from the outside by metal housing 22 of the microphone 4 and by that side of the hybrid 7 that is provided with a ground plane. Possible external components, like the components 9 and 10, that for example are necessary to decouple the power supply do not need to be shielded, because these components either operate on a relatively high signal level and therefore are much less sensitive for spurious RF signals, or do not affect the signal at all.

In the embodiment of FIG. 1 that shape of the microphone can be round, rectangular, or can have any other desired shape.

Figure 2:
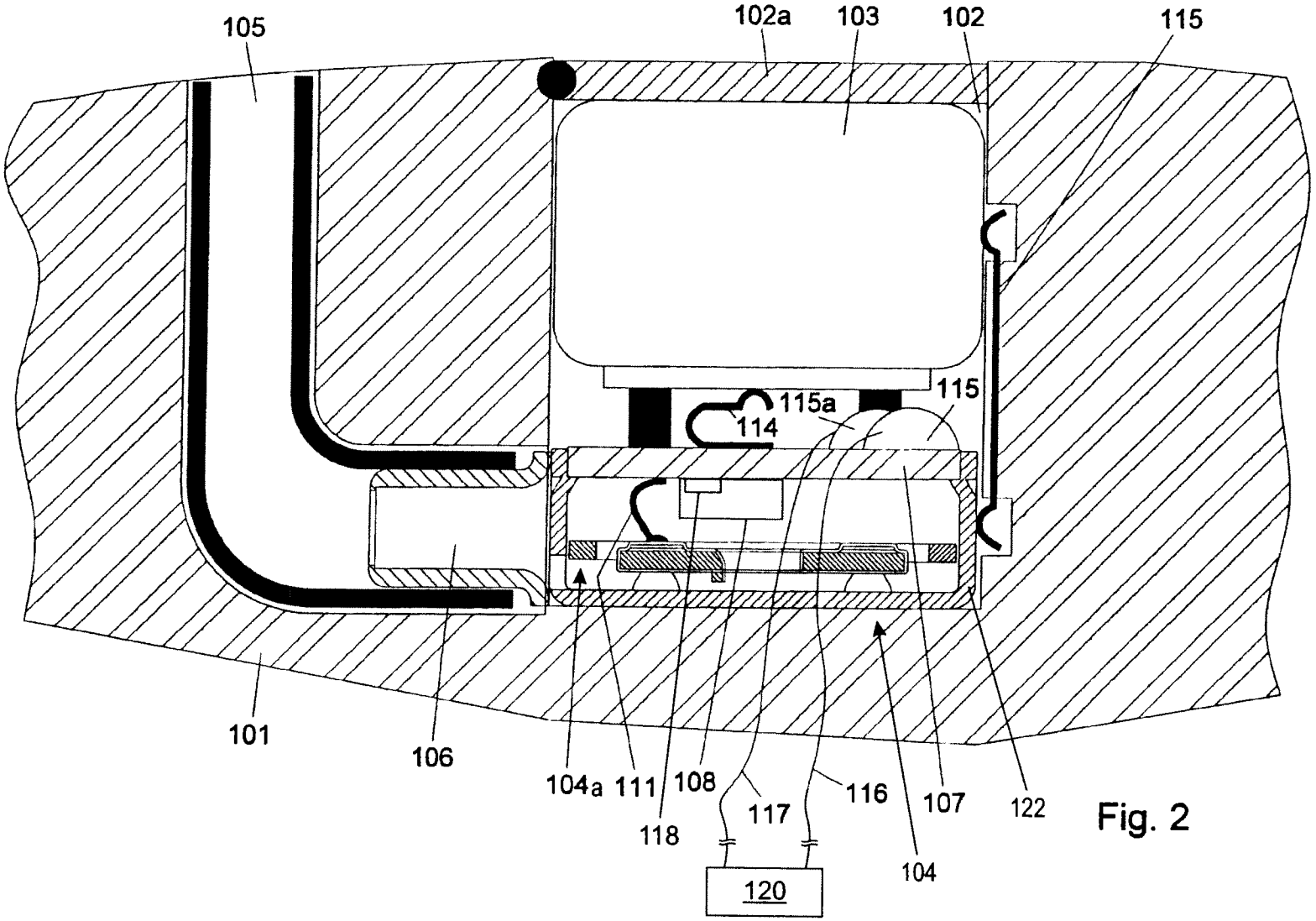
FIG. 2 a cross-sectional view of a second embodiment of the invention.

FIG. 2 shows another embodiment of the invention, in which the number of connecting wires is further reduced. The same components in this figure are indicated with the same reference numerals as in FIG. 1, but increase by 100. The hybrid 107 now is placed in such a way in the body, that it faces one side of the battery 103. Spring biased connecting elements 114 and 115 are provided to connect one terminal, generally the minus terminal of the battery 103, to the housing 122 of the microphone 104 and to connect the other battery terminal, generally the plus terminal, to the hybrid 107, respectively. The connecting wires 116 and 117 for transferring the output signal of the amplifier 118 to the receiver 120 remains the same, but now come from the other side of the housing 122 than in FIG. 1. These wires by means of solder pads 115, 115*a* are connected to the hybrid 107. In this embodiment the microphone 104 preferably is circular. The construction of this hearing aid, due to the spring biased, is very simple and inexpensive, while the short connections to the battery 103 also lead to a smaller chance on interference by RF sources. A transducer 104*a* is disposed within the housing 122 of the microphone 104.

Figure 3:
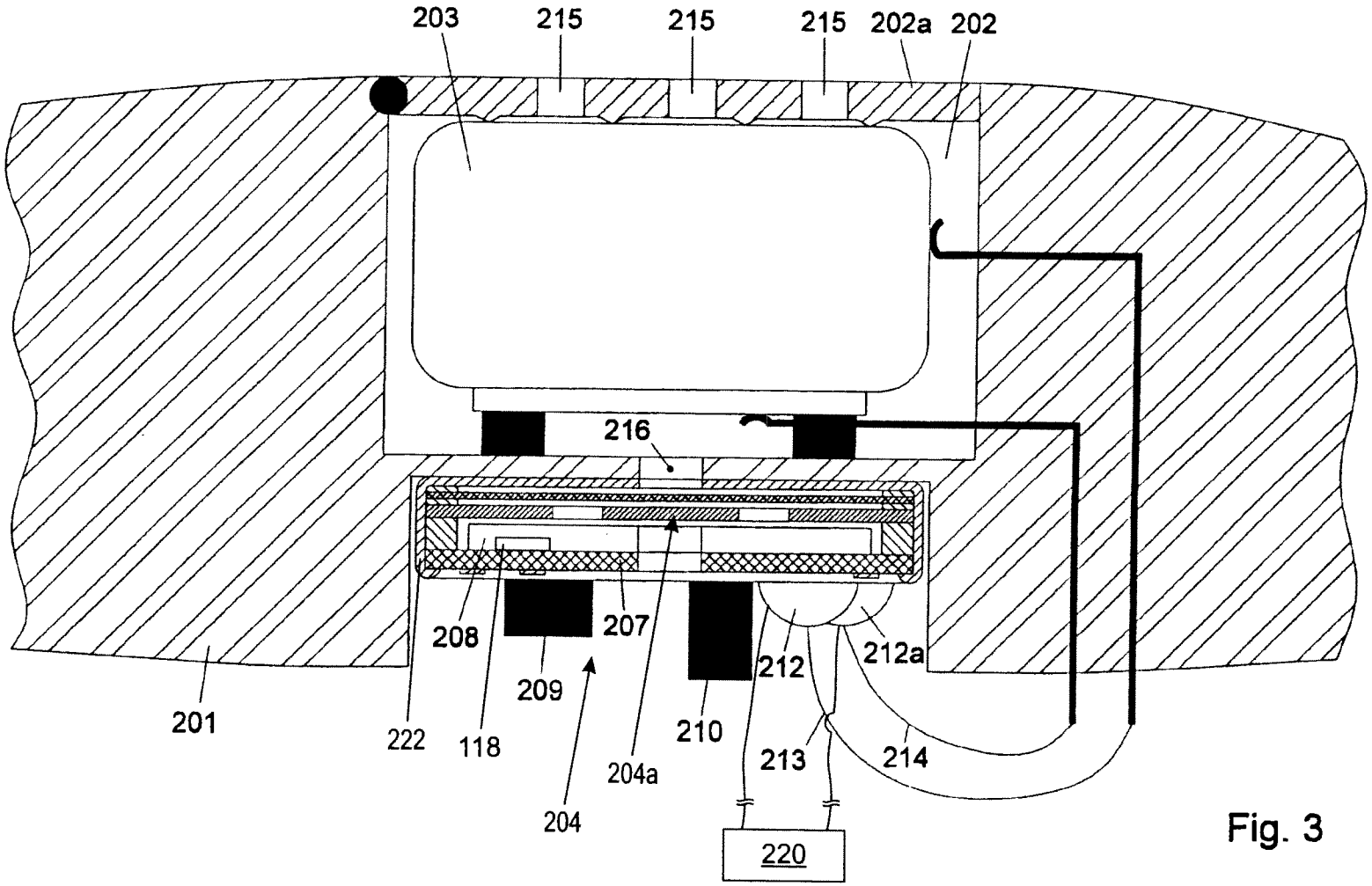
FIG. 3 a cross-sectional view of a third embodiment of the invention.

In the embodiment of FIG. 3 the connections to the battery 203 and to the receiver 220 are as in FIG. 1, and the same reference numerals as in that figure are used, but now increased by 200. In this embodiment the sound inlet opening for the microphone 204 as provided in the body 201 is changed into an advantageous configuration. In this embodiment the sound can enter the microphone 204 through openings 215 that are provided in a wall of the battery holder 202, preferably in the cover 202*a* thereof, and through an opening 216 in the wall of the battery holder 202 that faces the housing 222 of the microphone 204. As with FIGS. 1 and 2, a transducer 204*a* is disposed in the housing 222 of the microphone 204. By this construction sound waves enter the housing 222 of the microphone 204 via the battery holder 202 and the sound inlet of the microphone 204 is very well protected against sweat, dust, etc., which in the conventional embodiment often are detrimental for the reliability. By this construction also the bandwidth of the microphone 204 increases, because the acoustic mass of the conventional plastic tubing as sound inlet, such as shown in FIGS. 1 and 2, has an adverse effect on the frequency characteristics of the microphone 204.

The microphone of the above-described third embodiment requires less volume in a hearing aid than the conventional microphones. Therefore the flexibility in designing the hearing aid is larger, among others because the sound inlet does not require additional space on the front plate of the hearing aid, which also already is occupies by switches, potentiometers, etc. Further, nowadays different producers of hearing aids require microphones with different sound inlet channels. With the microphone according to the third embodiment also this problem belongs to the past.

What is claimed is:

1. A hearing aid, comprising a battery compartment having a first wall and a second wall adjacent to a microphone, said first wall having a first opening through which sound enters said battery compartment, said second wall having a second opening through which said sound passes from said battery compartment into said microphone.

2. The hearing aid of claim 1, wherein said first wall is removable.

3. The hearing aid of claim 1, wherein said microphone is protected against debris when a battery is disposed in said battery compartment.

4. An assembly, comprising:

a microphone;

a battery compartment having a first wall and a second wall adjacent to said microphone, said first wall having a plurality of openings through which sound enters said battery compartment and follows multiple paths around a battery disposed in the battery compartment toward a second opening that leads to said microphone.

5. The assembly of claim 4, wherein said first wall is a removable cover and said microphone is protected against debris when the battery is disposed in said battery compartment.

6. The assembly of claim 4, further comprising fixed spring biased connections that provide a solderless contact between said microphone and terminals of said battery.

7. The assembly of claim 4, wherein the sound changes direction at least three times along said multiple paths from when the sound first enters through said plurality of openings and travels around said battery to just before the sound enters said microphone.

8. The assembly of claim 4, wherein said multiple paths around said battery are formed by spaces between sides of said battery and said battery compartment.

9. The assembly of claim 4, further comprising a receiver and an electronic circuit that produces a signal that is transmitted directly to said receiver.

10. The assembly of claim 4, wherein said second opening is formed in said second wall.

11. The assembly of claim 4, wherein said first wall and a diaphragm of said microphone parallel to one another.

* * * * *

UNITED STATES PATENT AND TRADEMARK OFFICE

CERTIFICATE OF CORRECTION

PATENT NO. : 8,824,713 B2
APPLICATION NO. : 13/734659
DATED : September 2, 2014
INVENTOR(S) : Wilmink Engbert et al.

It is certified that error appears in the above-identified patent and that said Letters Patent is hereby corrected as shown below:

On the Title Page, Item (72), for Inventor, delete "Hendrik Dollerman" and insert --Hendrik Dolleman-- therefor.

Signed and Sealed this
Twenty-eighth Day of June, 2016

Michelle K. Lee

Michelle K. Lee
*Director of the United States Patent and Trademark Office*